United States Patent [19]

Dawson

[11] 4,117,936

[45] Oct. 3, 1978

[54] WIRE RACK

[75] Inventor: Robert L. Dawson, San Diego, Calif.

[73] Assignee: Prima International, San Diego, Calif.

[21] Appl. No.: 847,078

[22] Filed: Oct. 31, 1977

[51] Int. Cl.[2] ..... A47F 7/00

[52] U.S. Cl. ..... 211/50; 211/181; 211/200; 248/441 D; 248/460

[58] Field of Search ..... 211/50, 51, 181, 17, 211/20–24, 33, 37, 195, 200; 248/441 D, 451–453, 526, 460; 40/10, 13, 124–124.4, 358

[56] References Cited

U.S. PATENT DOCUMENTS

| | | | |
|---|---|---|---|
| 240,246 | 4/1881 | Fuller | 211/50 |
| 329,150 | 10/1885 | Eaton | 211/200 |
| 683,724 | 10/1901 | Carr | 248/453 |
| 793,914 | 7/1905 | Shumaker | 211/50 |
| 1,627,133 | 5/1927 | Ailes | 248/460 |
| 1,735,372 | 11/1929 | Block | 211/24 |
| 1,971,523 | 8/1934 | Feingold | 211/181 X |
| 2,214,137 | 9/1940 | Irwin et al. | 248/175 X |
| 2,474,763 | 6/1949 | Thomas | 211/50 |

*Primary Examiner*—Roy D. Frazier
*Assistant Examiner*—Terrell P. Lewis
*Attorney, Agent, or Firm*—Keith D. Beecher

[57] ABSTRACT

A self-clamping wire rack is provided for magazines, cards, napkins, letters, and the like; the rack being formed in its basic configuration of a first wire rod which is bent to constitute the rear side of the rack and also to constitute a pair of rearwardly extending legs; and of a second wire rod bent to constitute the front side of the rack and also constitute a pair of forwardly extending legs; the two components of the rack being hinged to one another in a manner such that when the assembly is placed on a horizontal surface, the front and rear sides are turned angularly towards one another to exert a clamping force on the magazines, cards, or other articles supported on the rack between the front and rear sides of the rack, so as to maintain such articles in the rack.

7 Claims, 2 Drawing Figures

WIRE RACK

BACKGROUND OF THE INVENTION

Wire racks of the general type with which the present invention is concerned are known to the art. Such racks are usually formed of wire rods which are bent into appropriate configurations, and which are welded, or otherwise attached to one another to form the rack. However, the prior art racks are static and are incapable of rigidly supporting varying numbers of articles of varying thickness.

The wire rack of the present invention, on the other hand, is dynamic, and it exhibits a self-clamping action, so that, varying numbers of articles of varying thicknesses may be securely supported in the rack regardless of the overall thickness of the articles.

DETAILED DESCRIPTION OF THE ILLUSTRATED EMBODIMENT

Figure 1:
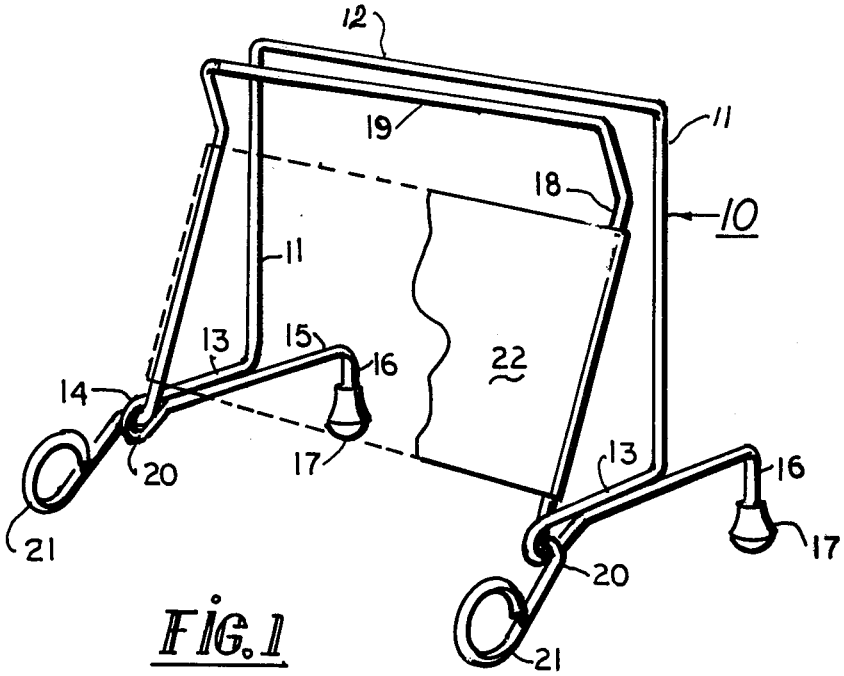
FIG. 1 is a perspective view of a self-clamping free-standing wire rack, which is especially suitable for supporting small articles, such as cards, napkins, envelopes and the like, and which is constructed in accordance with one embodiment of the invention.

The self-clamping free-standing wire rack of FIG. 1 is designated 10, and is formed of two wire rods 12 and 19, the rods being bent into a particular configuration, as shown. Specifically, the wire rod 12 is bent to form a U-shaped rear frame for the rack, the ends 11 of the frame being bent forwardly to provide space horiziontal support means 13 for the articles in the rack, and the ends of the frame then being bent to extend rearwardly to form legs 15. The extremities of legs 15 are bent downwardly to provide feet 16 which are covered with appropriate rubber-like tips 17. The junction between the portions 13 and 15 of the wire rod 12 at each end of the rack forms a pivot eye 14 which, in turn, serves as a pivotal connection with hinge portions 20 of the wire rod 19 which forms the front frame of the rack.

The wire rod 19 constituting the front frame of the rack, is bent, likewise, to have a U-shaped configuration, with legs 18, and outwardly projecting bends 20 extending through the eyes 14. The upper portion of the wire rod 19 is angularly bent outwardly to provide a V-shaped space between the rear and front frames of the rack for receiving the articles to be supported in the rack. The lower ends of the legs 18 are looped to form appropriate front feet for the rack. A display panel 22, or plaque, may be clamped to the front frame 19 for ornamental purposes.

The rack of FIG. 1 serves to support and hold relatively small articles such as envelopes, cards, napkins and the like. When such articles are placed within the rack, and supported on the portions 13 of wire rod 12, the resulting gravitational force causes the upper portion of the front frame to press against the rear frame, thereby firmly clamping the articles supported in the rack.

Figure 2:
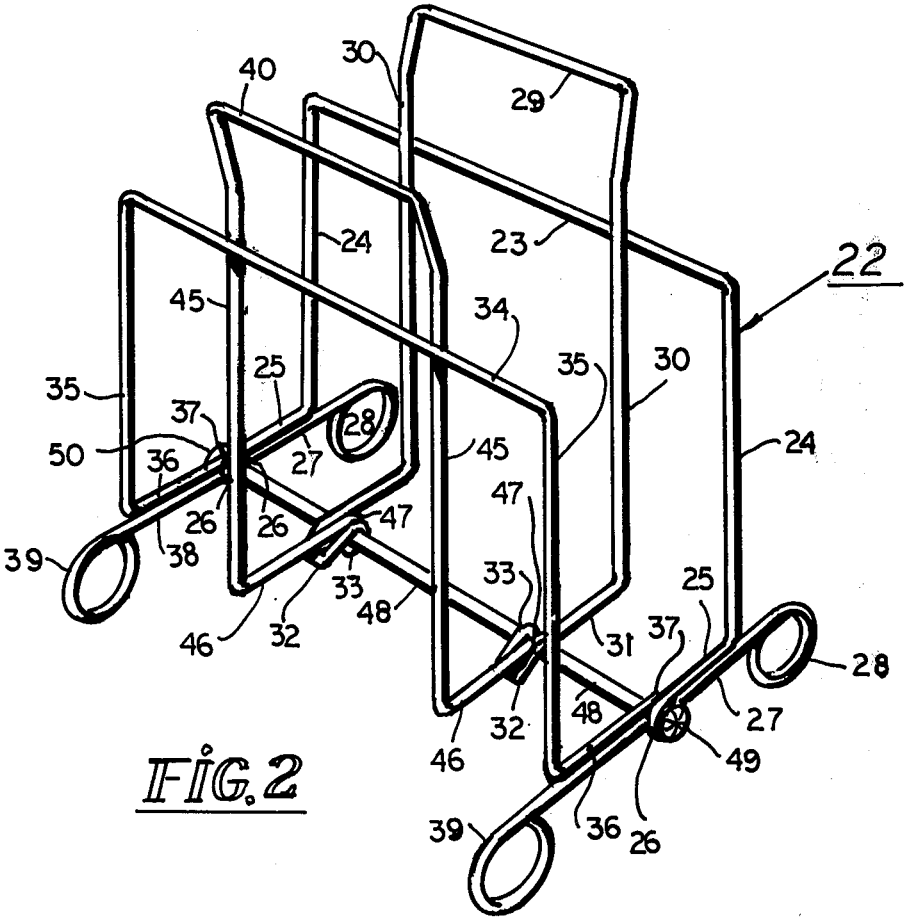
FIG. 2 is a perspective representation of a self-clamping free-standing wire rack which is particularly suited for supporting heavier articles such as magazines, telephone books, and the like, and which constitutes a second embodiment of the invention.

The embodiment of the invention shown in FIG. 2 comprises a rack 22 which is formed of two identical U-shaped main frames, 23 and 34, each formed of a bent wire rod. Each of the frames 23 and 34 has substantially the same configuration as the rear frame in the embodiment of FIG. 1, with the exception that in the illustrated embodiment of FIG. 2, the frames have looped footings 28 and 39 extending downwardly from horizontally extending legs 27 and 38. Reverse bent portions 25 and 36 form pivot eyes 26 and 37 at each end of each frame, the frames also having vertically extending ends 24 and 35 which serve to complete the U-shaped configuration of the frames.

Additional wire rods are welded to the main frames 23 and 24, and are formed into U-shaped frames 29 and 40, each having vertically extending ends 30 and 45 which are connected to one another by respective bite portions which complete the U-shaped additional frames of 29 and 40. The upper ends of the frames 29 and 40 are bent outwardly so that the articles to be supported may be received by the rack. The upper end of the frames 29 and 40 also provide handles for the rack.

The lower ends of the vertical portions 30 and 45 of the frames 29 and 40 are bent inwardly to form horizontal portions 31 and 46. The ends of the horizontal portions 46 are bent over to form pivot eyes 47; and the ends of the extending portions 31 are bent to form U-shaped ends 32 with reverse bent over portions to form pivot eyes 33, and which extend under the horizontal portions 46. A hinge rod 48 is provided which extends through the eyes 33 and 47, and through the eyes 26 and 37, the hinge rod being fitted with end caps 49 and 50.

The portions 21 and 46 of the frames 29 and 40, and the portions 25 and 36 of the frames 29 and 34 form carrying arms for the articles supported in the rack. It will be appreciated that when articles are placed within the rack, the weight of the articles will cause the frames 23, 34 and 29, 40 to turn inwardly about the hinged rod 48, so that the articles may be clamped within the rack and rigidly held therein. The relationship between the portions 32 of rack 29 and carrying arms 46 of rack 40, prevents the rack from opening when lifted for example, by the upper end of either frame 40 or frame 29.

The invention provides, therefore, an improved self-clamping free-standing wire rack which is simple in its construction and inexpensive to manufacture. The rack of the invention serves rigidly to clamp articles inserted between its frames, so as to provide a secure storage for magazines, newspapers, and the like.

While particular embodiments of the invention have been shown and described, modifications may be made, and it is intended in the appended claims to cover such embodiments as fall within the spirit and scope of the invention.

What is claimed is:

1. A wire rack for supporting magazines, and the like comprising: a first wire-formed frame having an essentially U-shaped configuration and having lower article-carrying end portions extending forwardly of the plane of the frame and having a further lower end portion extending rearwardly of the plane of the frame to constitute rear legs for the rack; and a second wire-formed frame having an essentially U-shaped configuration hinged to the first frame in facing relationship therewith, said second wire-formed frame having lower end portions extending forwardly of the plane of the second frame to constitute front legs for the rack, whereby articles supported on the article-carrying portions of the first frame cause the first and second frames to turn angularly toward one another to exert a clamping action on such articles.

2. The wire rack defined in claim 1, in which said rear legs have downwardly extending feet portions formed at the extremities thereof, and in which said forward said front legs also have downwardly extending feet portions at the extremities thereof.

3. The wire rack defined in claim 1, in which the forwardly extending and rearwardly extending lower end portions of the first frame form pivot eyes which receive the lower end portions of the second frame to provide a hinge coupling between the first and second frames.

4. The wire rack defined in claim 1, in which said first wire-formed frame and said second wire-formed frame have similar shapes and in which said second frame also includes lower article-carrying end portions extending rearwardly from the plane of the second frame.

5. The wire rack defined in claim 4, in which the forwardly extending end portions and the rearwardly extending end portions of the first frame form pivot eyes; and in which the rearwardlyextending portions and forwardly extending portions of the second frame also form pivot eyes, with the aforesaid pivot eyes all being axially aligned with one another; and which includes a rod extending through said pivot eyes to couple the first frame and second frame to one another in a hinged relationship.

6. The wire rack defined in claim 5, and which includes a third U-shaped wire-formed frame secured to said first frame, and including lower article carrying end portions extending forwardly from the plane of said second frame, with the extremities thereof looped around said rod; and a fourth U-shaped wire-formed frame secured to said second frame and having lower article-carrying end portions extending rearwardly from the plane of said fourth frame and having extremities looped around said rod, the first and third frames being in essentially co-planar relationship, and the second and fourth frames being in essentially co-planar relationship, and the third and fourth frames extending upwardly beyond the first and second frames to constitute handles for the rack.

7. The rack defined in claim 6, in which the extremities of the lower end portions of the third frame extend under the lower end portions of the fourth frame to provide a stop means for preventing angular opening movement of the rack beyond a predetermined angular relationship between the first and second frames thereof.

* * * * *